United States Patent [19]

Dietrich et al.

[11] 4,332,349

[45] Jun. 1, 1982

[54] CENTRIFUGE

[75] Inventors: Jürgen Dietrich, Lilienthal; Hansjörg Klotz, Sottrum; Bernd Hofer, Lemwerder, all of Fed. Rep. of Germany

[73] Assignee: Erno Raumfahrttechnick GmbH, Bremen, Fed. Rep. of Germany

[21] Appl. No.: 178,155

[22] Filed: Aug. 13, 1980

[30] Foreign Application Priority Data

Aug. 14, 1979 [DE] Fed. Rep. of Germany ..... 2932849

[51] Int. Cl.[3] ..... B04B 9/10; B04B 11/00

[52] U.S. Cl. ..... 233/1 R; 233/26; 350/23

[58] Field of Search ..... 233/1 R, 26, 27, 28, 233/7, 2, 3, 4, 6, 10, 17, 18, 21, 22, 40; 350/23

[56] References Cited

U.S. PATENT DOCUMENTS

| | | | |
|---|---|---|---|
| 1,253,037 | 1/1918 | Horstmann | 233/27 |
| 2,454,959 | 11/1948 | Barnes | 350/23 |
| 2,966,096 | 12/1960 | D'Incerti | 350/23 |
| 3,009,388 | 11/1961 | Polanyi | 233/26 |
| 3,391,597 | 7/1968 | Gropper | 233/26 |

*Primary Examiner*—Robert W. Jenkins

*Attorney, Agent, or Firm*—Ralf H. Siegemund

[57] ABSTRACT

A centrifuge for biological specimens is constructed to include one or two additional concentric rotors being independently drivable and provided with means for transfer of objects to and/or from the main centrifuge. The rotating specimen is under observation from a stationary observation point.

7 Claims, 5 Drawing Figures

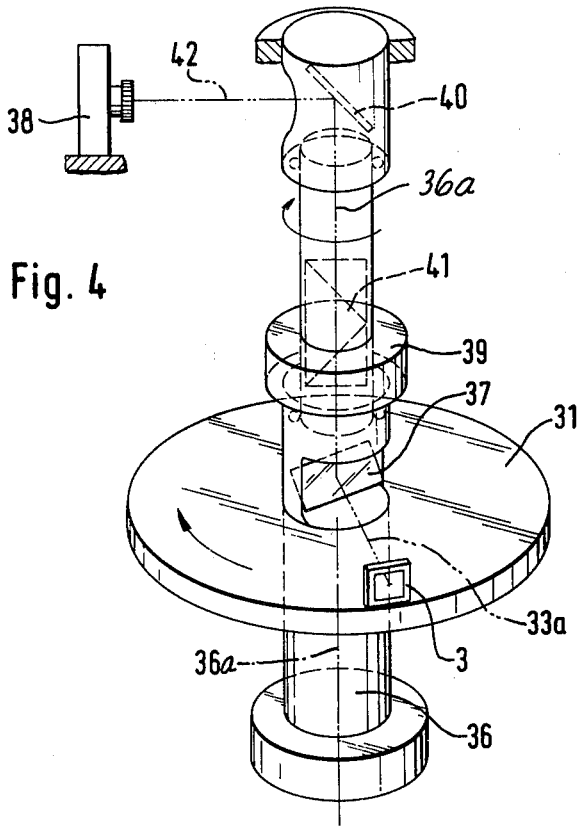
Fig. 4
Fig. 5
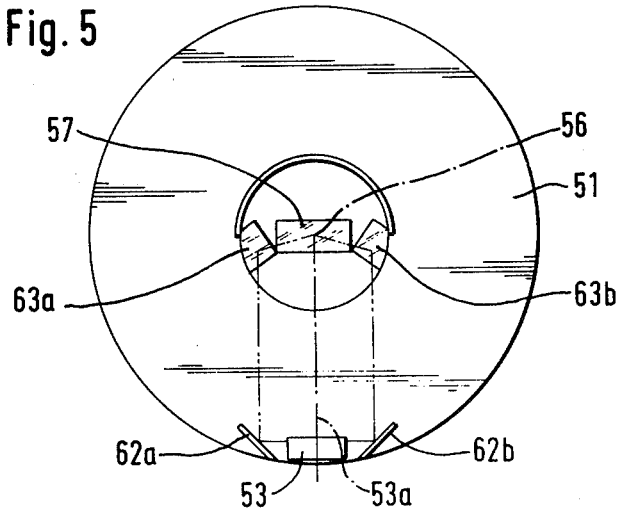

CENTRIFUGE

BACKGROUND OF THE INVENTION

The present invention relates to a centrifuge particularly of the type used in biophysical experimentation.

Since the beginning of outer-space exploration, it has been of great interest to examine the effects of nogravity as well as of higher-than-normal gravity on living organisms. In particular, larger g-forces are simulated or generated by means of centrifuges. The diameter of the centrifugal circle as well as the rotational speed are directly translatable into g-forces. Numerous centrifuges are known for this purpose.

Recently, greater interest has arisen in the generation of variable accelerations or g-values. Also, it has become of interest to devise a centrifuge in such a manner that a specimen or sample can be placed onto or into the rotating part of the centrifuge while it rotates. This is quite difficult to do because the linear acceleration of the object as it is being placed onto the centrifuge is quite significant though temporary. This sudden acceleration may be a part of the experiment, but it may also create undesirable side effects. In any event, the effects that the centrifugal forces have on the specimen and sample should be closely observed. Actually, it is desirable to observe the object visually throughout.

DESCRIPTION OF THE INVENTION

It is an object of the present invention to provide a new and improved construction for centrifuges which permits placement and removal of objects without having to stop the device and which permits further continuous observation of the object while being rotated by the centrifuge.

It is a specific object of the present invention to improve a centrifuge having a rotor and holding objects to be moved on a particular circle.

The centrifuge, in accordance with the specific object, is improved in accordance with the preferred embodiment of the present invention in that at least one second additional rotor is provided which is axially movable on the principal rotor shaft and can be driven independently. This second rotor can be synchronized with the first one in order to permit a transfer of an object from one rotor to the other, while the second rotor can be independently stopped and started.

The principal rotor is provided in addition with optical devices including one or more mirrors for directing an image radially towards a stationary observation device, such as a TV monitor, a movie camera, or the like.

The preferred embodiment of the invention, the objects and features of the invention, and further objects, features and advantages thereof, will be better understood from the following description taken in connection with the accompanying drawings.

DESCRIPTION OF THE DRAWINGS

FIG. 4 illustrates, in a similar view, an improved observation supplementation; and FIG. 5 is a top view to illustrate a still further improvement in the observation of an object or the principal rotor of the centrifuge.

Proceeding now to the detailed description of the drawings, FIG. 1 illustrates a star-shaped rotor 1 of a centrifuge and having arms for holding object carriers 4 at a particular distance from the axis 6*a* of rotation. The rotor 1 sits on a shaft 6, rotating therewith. Reference numeral 21 refers to a drive for the centrifuge rotor. The carriers 4 are provided and constructed for receiving and holding objects 3. These objects are suitable containers, cartridges, or the like, containing biological specimens and samples. Normally, i.e. prior and/or subsequent to being centrifuged, these containers are held in a rack 5.

Figure 1:
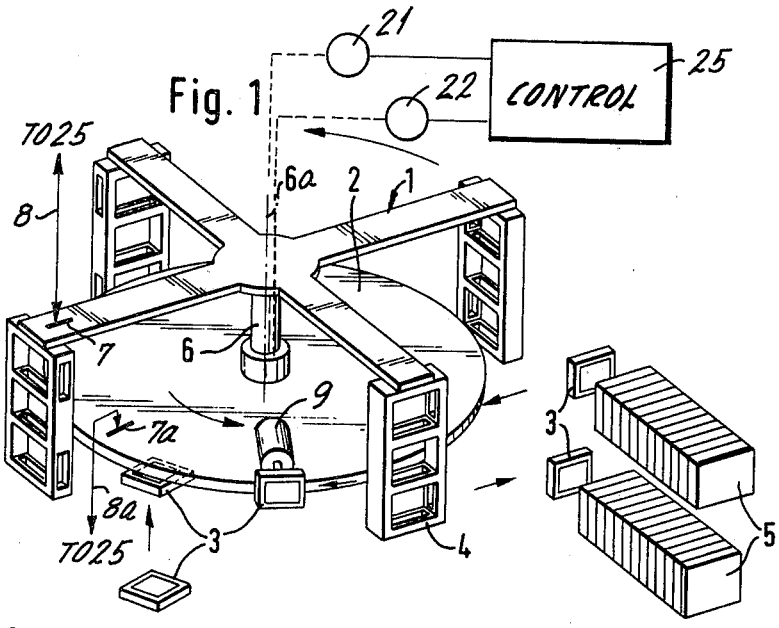
FIG. 1 illustrates an isometric view of a rotor of a centrifuge with a second rotor in accordance with the preferred embodiment.

A second, auxiliary rotor 2 has a hub element 2*a* which is traversed by shaft 6. Rotor and hub can axially move on the shaft and do not (necessarily) rotate therewith. Rather, rotor 2 is provided with its own, independent drive 22. Thus, rotor 2 can be stopped or accelerated independently from the principal centrifuge rotor 1; but through appropriate synchronization and speed control, the two rotors can be made to rotate at the same rotational speed.

By way of example, the two drives may be three-phase, synchronous motors having similar pole part numbers. Alternatively, the two motors 21 and 22 may be dc shunt motors, each being feedback-controlled as to speed. The control circuit 25 will be constructed to slave the motor 22 to the motor 21 whenever speed synchronization is desired.

It can thus be seen that rotor 2 can be slowed down, stopped, and shifted axially off shaft 6*a* so that, e.g., a new object 3 can be placed thereon. The new object 3 was taken from store 5 and is preferably, suitably fastened to the rotor 2. The rotor 2 is returned to shaft 6 and accelerated until its speed matches the speed of rotor 1.

As indicated schematically by markings 7 and 7*a*, respectively scanned by pick-up transducers 8 and 8*a*, the relative phase of the rotors 1 and 2 is ascertained, and the drive controls 25 are synchronized and phase-shafted until these markings have a particular phase relative to each other. That phase is not always the same; it depends upon the desired position of the holder for the respective carrier 3 on rotor 2 vis-à-vis a particular arm of the star-shaped rotor 1.

The object 3 is hung onto rotor disk 2 and will fold into a vertical position, particularly so when disk 2 begins to rotate. A suitable electromagnet 9 on auxiliary rotor disk 2 will push one side of object 3 to slip into the upper pocket of a carrier 4. The phase control operates in this case to cause the rotor disk 2 to creep into a phase of radial alignment between one of the four carriers and objects. The respective carrier thus scoops the object up.

By means of a suitable gripper, or the like, on rotor disk 2, operating in conjunction with a slow desynchronization of the speeds of the rotors, an object may be drawn out from the lowest one of the three compartments in each of the carriers. Thereafter, the rotor 2 is slowed down, stopped, and the object 3 is removed.

The system may operate in that normally an object sits in the middle compartment, and the two other compartments are provided for cooperation with their respective transfer devices on the auxiliary or additional rotor 2.

Figure 2:
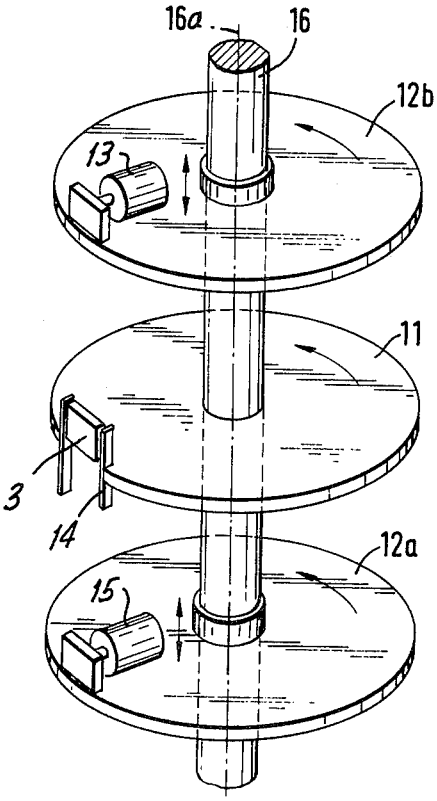
FIG. 2 illustrates a similar view of a different primary rotor with a second rotor still in accordance with the preferred embodiment.

FIG. 2 illustrates another example of the invention, taken in conjunction with a simplified primary centrifuge. This centrifuge is just a simple disk 11 on a shaft 16, rotating therewith and carrying a sample holder 3. In addition, two auxiliary rotors, 12*a* and 12*b*, are provided, having hubs to permit up- and down-sliding (double arrows) on shaft 16, having axis 16*a*.

The rotors 12*a* and 12*b* are independently driven and controlled with regard to their speed. These auxiliary centrifuges 12*a* and 12*b* respectively serve for placing new objects onto the principal centrifuge 11 and remove such objects therefrom.

For example, the object 3 on rotor disk 12*b* can be pushed forward by a solenoid 13 and released, whereupon it will drop into a chute 14 on the periphery of the principal rotor 11. The chute 14 has retractive stops in order to hold the object in the illustrated position. Subsequently, rotor disk 12*a* is being synchronized with rotor 11; its retractable holder 15 must be aligned with chute 14. The first-mentioned stops are retracted, and the object 3 falls but is stopped by a second set of stops in the bottom of the chute. This object is now in the range of gripper 15 which will retract the object 3 onto disk 12*a* which, in turn, will be slowed down and stopped for removal of the object.

Figure 3:
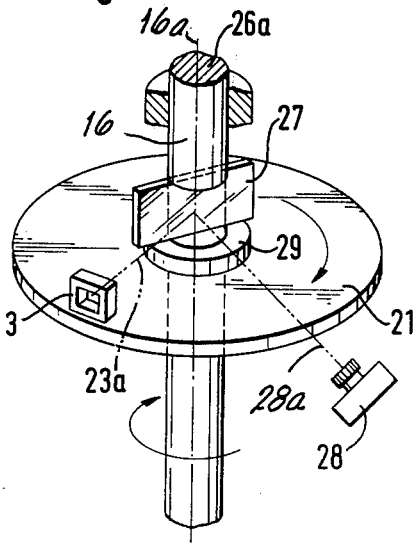
FIG. 3 illustrates supplemental equipment for the centrifuge shown in FIG. 2 and designed to permit the observation of an object or the principal rotor.

FIG. 3 illustrates another detail of this centrifuge, in particular for observing the specimen in holder 3. The shaft 16 is constructed to incorporate a reflector 27 having its two oppositely directed reflective surfaces situated in such a way that the axis 16*a* runs very close to and parallel to both surfaces. The reflector 27, however, does not directly rotate with the shaft; rather, a gear is interposed for reducing the reflector's rotational speed by one-half the speed of the shaft.

A stationary observation device 28 is located to have its axis 28*a* of observation intercept the reflector surfaces near the axis of rotation. The device 28 may be a TV-monitor, or a film camera. Due to the rotational speed differential of the mirror 27 and of the rotor disk 11, mirror 27 will always reflect an image of object 3 into this stationary, radial axis of observation 28*a*. Thus, the object is under continuous observation, except for two brief periods; one occurs when the mirror is located edge-on to the observation device, which happens once during one rotor resolution (twice per turn of mirror 27), and again when the object 3 is directly in line with the mirror and the observation unit 28.

The device shown in FIG. 4 includes a more elaborate observation system which avoids the "blind pauses" above. The centrifuge disk is denoted by numeral 31 sitting on a shaft construction 36 which rotates on an axis 36*a*. An object 3 sits on the rotor disk. The shaft is at least in parts of hollow construction and includes a reflector 37 which is inclined by 45° to the axis of rotation 36*a*. It rotates directly with the shaft and the object facing the latter and, thus, permitting its continuous observation on the axis 36*a*.

An image-erecting prism 41, e.g. a dove prism, is disposed in shaft 36, its optical axis coninciding with the axis 36*a*. A separate drive or reducing gear rotates the image-erecting prism at half the centrifuge's speed. Another mirror, 40, is disposed above the shaft. Mirror 40 is stationary and directs light along an observation path 42 towards a stationary observation unit 38. As the centrifuge rotates, and dove prism 41 rotates at half the speed, the object 3 remains continuously observable in shaft 36. The image provided by mirror 37 rotates, but the dove prism 41 suppresses the image rotation so that a stationary image can be observed by device 38, again along a radial observation path. Strictly speaking, one could observe the erect image directly on axis 36*a*; but this is impractical and interfers with the operation and support of the centrifuge.

FIG. 5 illustrates a further observation supplement. The object 3 on the centrifugal rotor disk 3 is additionally observed from its sides, by means of mirrors 52 and 53, cooperating with mirrors 62 and 63 in shaft 36 and being inclined by 45 degrees to the plane of rotation. These mirrors direct reflected light towards central reflector 37, but the remainder of the system is as shown in FIG. 4.

Other mirrors can be suitably placed on the rotor disk in order to reflect different observation views of the object into the common axis of rotation for external, stationary observation.

The multiple observation fields permit, for example, the observation of effects that acceleration has on various organisms, including zero acceleration if the centrifuge is used in a space laboratory, as well as many g-forces.

It can readily be seen that the equipment permits the uninterrupted long-time testing, etc., of specimens, while other specimeans are removed earlier and/or added later to permit, for example, the concurrent observation of similar or different specimens under similar gravity conditions, but having been so exposed for different periods of time.

The invention is not limited to the embodiments described above; but all changes and modifications thereof, not constituting departures from the spirit and scope of the invention, are intended to be included.

We claim:

1. In a centrifuge having a first rotor for receiving carrier and holder units containing, e.g., biological specimens, the rotor having a shaft, the improvement comprising:

at least one additional rotor mounted concentrically to said shaft, but being independently rotatable, the additional rotor being provided with means for holding a carrier and holder unit;

means for driving the additional rotor independently from the centrifuge rotor; and control means connected to the means for driving for synchronizing the rotoational speeds of the rotor and the additional rotor, to permit transfer of a carrier and holder unit from one to the other.

2. In a centrifuge having a first rotor for receiving carrier and holder units containing, e.g., biological specimens, the rotor having a shaft, the improvement comprising:

at least one additional rotor mounted concentrically to said shaft, but being independently rotatable;

means for driving the additional rotor dependently from the centrifuge rotor;

a stationary observation device; and optical means, including mirror means mounted on the first rotor for directing an observation field which includes a holder on the first rotor, towards the stationary observation device.

3. In a centrifuge as in claim 2, including means for rotating the mirror means at half the centrifuge's speed so that an image of the object is observable along a radial, stationary direction.

4. In a centrifuge as in claim 2, the mirror means being disposed in the axis of rotation, the optical means further including an image-erecting means on said axis and rotating at half the rotational speed of the first rotor, further including a stationary mirror for deflecting the image from the erecting means towards a radial observation path.

5. In a centrifuge as in claim 2, the mirror means including differently oriented mirrors for observing different sides of the object.

6. In a centrifuge as in claim 1 or 2, including means for a transfer of objects in axial direction as between the rotors.

7. In a centrifuge as in claim 1 or 2, including means for a transfer of objects in peripheral direction as between the rotors.

* * * * *